US005624122A

United States Patent [19]

Winkelhorn

[11] Patent Number: 5,624,122

[45] Date of Patent: Apr. 29, 1997

[54] SPORT GAME AND FIELD

[76] Inventor: Karin-Maria K. Winkelhorn, 1107 S. Fifth Pl., Las Vegas, Nev. 89104

[21] Appl. No.: 683,669

[22] Filed: Jul. 17, 1996

[51] Int. Cl.[6] ..... A63B 71/00

[52] U.S. Cl. ..... 473/471; 482/29

[58] Field of Search ..... 273/393, 411; 482/27, 29

[56] References Cited

U.S. PATENT DOCUMENTS 3,201,126 8/1965 Nissen ..... 273/393

*Primary Examiner*—William H. Grieb
*Attorney, Agent, or Firm*—Beehler & Pavitt

[57] ABSTRACT

A competitive sport, and a facility for playing the same, the facility having a raised planar playing field formed of a plurality of rectangular trampoline-like channels held together edgewise by supporting cables with all of the adjacent edges and cables being covered by padding. The rectangular planar field is preferably circumscribed by additional similar panels angled upwardly and outwardly from the edges of the planar field with goals being provided in each of the end angled panels. The playing field may be divided and marked in predetermined ways depending upon the rules of the game. In one form, the game may involve two teams; one provided for each half of the field, with each team taking turns for prescribed periods in attempting to project a ball into a goal at the angled panels projecting upwardly from the end of the opponents' side of the field, while the defendant's attempt to thwart the defensive team's attempts to make a goal. The total number of goals scored by each team are totaled after the expiration of allowed play periods to determine the winning team.

9 Claims, 3 Drawing Sheets

SPORT GAME AND FIELD

FIELD OF THE INVENTION

This invention relates to spectator sports generally, although there is no requirement that the game of the present invention be played before spectators. The game of the present invention has certain similarities to basketball, hockey and soccer, but is quite different from all of them.

BACKGROUND OF THE INVENTION spectator sports, such as football, baseball, basketball, hockey and soccer, have become so extensively promoted as spectator sports that the team owners have been enabled to pay very lucrative salaries to the team members and team conquests, through professional leagues, have become major business activities, both in the United States and in certain foreign countries.

Each of these sports, however, suffers from various periods of boredom for spectators, even during what may be considered "action". Also, even when "action" occurs, it may be routine and unexciting. Examples would be free throws in basketball, unproductive ground plays in football, catching a fly ball in baseball, and much movement in both soccer and hockey.

In addition, action of the players is generally limited to body movements on stable surfaces, such as ground, wood floor or ice rinks, which movements may be limited by the normal physical capabilities of the players as human beings. An exception may be the sport of water polo, but actually the water in which the game is played, tends to limit quick movements of the participants.

SUMMARY OF THE INVENTION

The present invention provides an added dimension to competitive sports in that the surface upon which the game of the present invention is played is resilient, with the result that the normal movement of players in running and jumping may be so modified as to enable the game participants to perform feats of which they would not be capable of performing on conventional ground, broad or ice surfaces.

The underfoot resiliency may be effected by providing a planar field constructed of adjacent rectangular trampoline-type panels supported by and on crossing cables, which cables themselves are supported at the edges of the field by being secured to a plurality of vertical posts.

The concept of using this; type of underfoot surface may be utilized in a number of different types of game contests. However, in the presently preferred form, the field may be rectangular, divided in half with goals or targets at each end to be protected by defending members scatteredly stationed in their half of the field, as members of the opposing team attempt to move into the defenders' field in an effort to place a ball or other playing object into some type of goal or target disposed on the end wall behind the half of the field being defended.

In one embodiment of the invention, both the sides and ends of the field are bordered by sides formed of resilient panels which rise from the edges of the planar and extend outwardly from the panels at approximately a 45 degree angle.

The actual playing field in the presently preferred embodiment may be a 75 foot by 165 foot long rectangle with side panels of between 15 and 18 feet in height extending from the edges of the rectangular field angularly upwardly and outwardly. The end and side panels greatly enhance the safety of the players who will frequently be found to cross the edges of the planar portion of the field. The field and its end and side panels are formed by an assembly of 15 foot by 15 foot heavy fabric sheets. From the edges of each sheet extend six to ten inch long outwardly projecting spring connectors.

The panels are supported by a grid of steel cables, each of which may be between ½ of an inch to ¾ of an inch in diameter. The longitudinal cables will preferably cross or be crossed in abutment with the transverse cables, and the outer cables will be attached at their ends to heavy supporting poles, such as telephone poles, or steel poles embedded securely in the surrounding ground surface. The panels springs will be attached to the cables forming the grid, with parallel cables being spaced from each other by a distance equal to the width or length of the panel, plus twice the length of the springs, when the latter are extended. The outer ends of the springs of each panel will be hooked over the cables supporting the panel. To prevent injury to the players who may fall or bounce along a strip of the field above a cable to which the end springs of adjacent panels are hooked or otherwise attached, a strip of resilient material, such as rubber approximately three feet wide will attach to and over the springs, thereby covering the springs and the cable over which the padding is laid and to which its underside is attached.

The angled end panels of the thus formed court may be provided with one or more goal openings, and the rectangular planar surface of the court may be marked for various purposes, such marking preferably being accomplished by providing different color panels disposed at predetermined locations. For at least one form of a playing surface, the rectangle may be bisected transversely into two opposing half-courts.

To play a game on the field or court thus described, two teams of players are placed on opposite sides of the bisecting line of the court or playing field. Each team may be comprised of some plurality of players, of either or both sexes, as, for example, each team might have as its players two women and four men. The object of the game is to advance a ball, which may be generally the size and shape of a football formed of a foam and plastic. The ball should be resilient enough to avoid injuring a player who may be hit by it.

In one form of the game, one team is given possession of the ball for a period of five minutes in which to score one or more points by getting through the defensive team to throw or otherwise deposit the ball in one of the opposing team's goals. The ball may be advanced by throwing, running and kicking on the field which, because of the resiliency of the panels, may enable a player to bounce into the air, either from a planar field panel or from an angled side panel. Because of the resilient nature of the field panels, it may be expected that movements of players across them will be erratic and, when players acquire sufficient skill, most unusual, through the trampoline effect of the resilient panels.

In one form of the game, it may consist of four ten minute quarters, with a five minute break between each quarter. If the side having possession of the ball fails to score during its five minute possession period, the ball is then turned over to the opposing team for its five minute possession period.

Among rules for a preferred form of the game, tackling would be permitted only on the field surface. Blocking and bumping are permitted by a defensive player who is airborne.

Also, in the preferred form of the game, each side of the field is marked with a central circular area. When a player enters that area, if he or she chooses to throw the ball, the player must jump or bounce into the air to accomplish the throw.

When a plurality of goal receptacles are provided at each end of the field, one such goal should be centered and any allowed foul shots must be directed to such center goal.

In the presently contemplated form of the game, the panels abutting the angled end rising up from the planar field are specially marked, such as, in red to form an "end zone" and a permanent goalie is stationed in this red end zone. To block any attempt on goal, the goalie must move or bounce in the air within the red end zone.

There may also be provided an additional specially marked center zone, which may comprise three panels in length and extend completely across the width of the planar portion of the field, with one and a half panels on each side of the bisector. This zone may also be marked in red and, whenever a player enters any of the three specially marked zones (the center zone and each end zone) the player must be bouncing in the air or otherwise moving continuously until he or she leaves such zone.

Because of the resiliency and trampoline-effect of the panels comprising the planar field, as well as the end and side angled bordering panels, it may readily be appreciated that the game adds a new dimension to such competition sports as soccer, basketball or hockey. It will, of course, require some teaching, and practice, on the part of players to acquire skill in playing the game, but skillful players utilizing the bounce effects of the panels, will not only enjoy the game itself, but will provide a sport of great interest to spectators.

DESCRIPTION OF THE DRAWINGS

In the accompanying drawings.

DESCRIPTION OF THE PREFERRED EMBODIMENT

Figure 1:
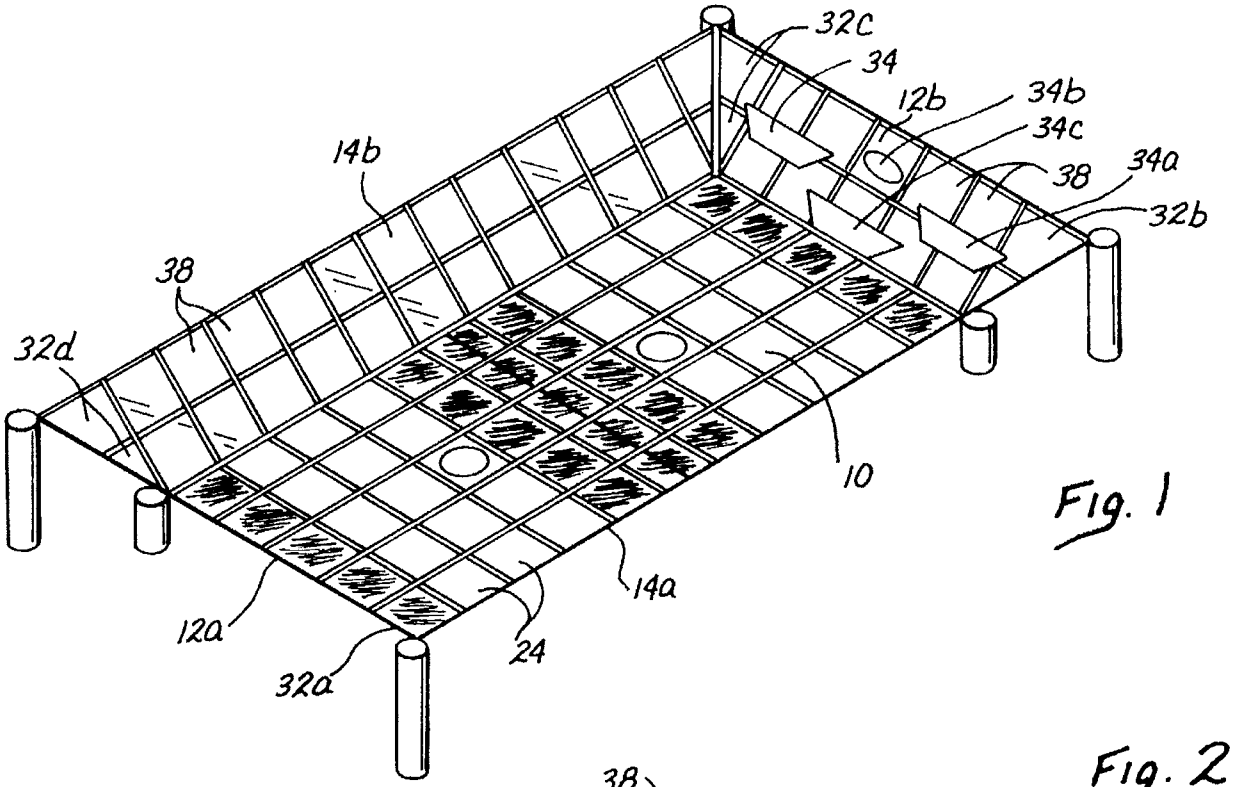
FIG. 1 is a perspective view of the basic structure of the field.
Figure 2:
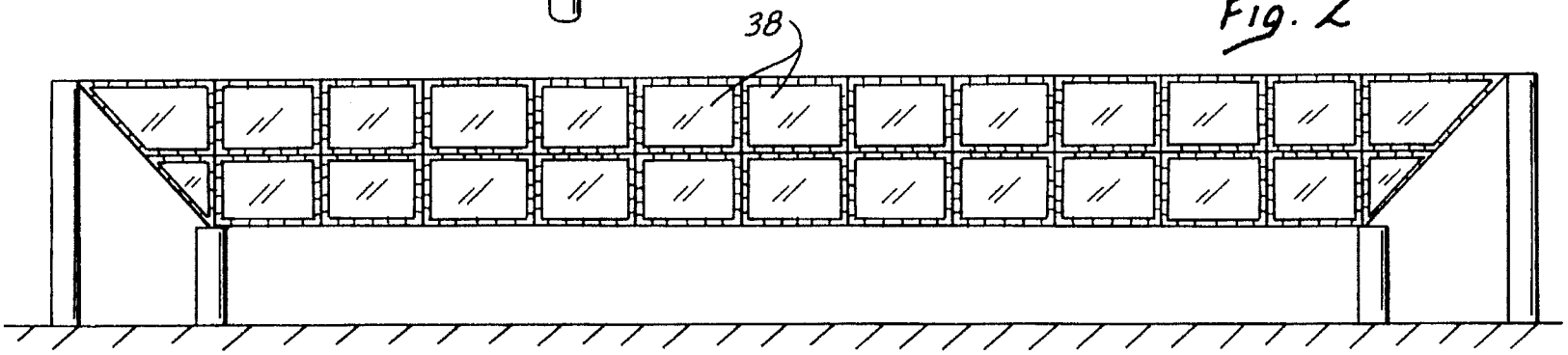
FIG. 2 is an enlarged side elevation of the field shown in FIG. 1.
Figure 3:
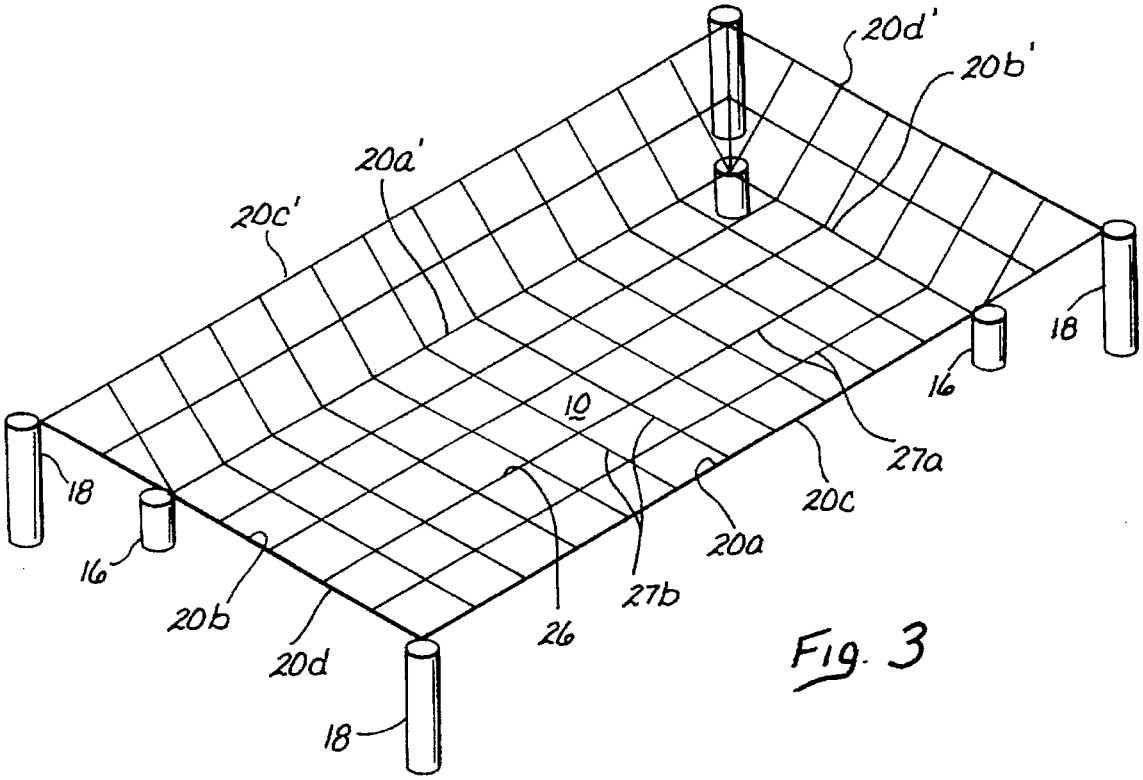
FIG. 3 is a perspective view of the field shown in FIG. 1 without the posts, but showing in phantom the disposition of cable supports for the planar field and side panels.

The basic layout of the field of the present invention is shown in FIG. 1, and comprises a planar rectangular field 10, 155 feet in length by 75 feet in width. This planar field 10 is circumscribed by upwardly and outwardly extending angled ends 12*a*, 12*b*, and sides 14*a*, 14*b*. As best shown in FIG. 3, the configuration of the planar field 10 and its ends 12*a*, 12*b* and sides 14*a*, 14*b*, may be maintained by a grid of steel cables 20*a*, 20*a'*, 20*b*, 20*b'* and 20*c*, 20*c'*, 20*d*, 20*d'* secured to the upper ends of inner posts 16 and outer posts 18. The planar rectangular field 10 and its sides 12*a*, 12*b*, and ends 14*a*, 14*b* are actually formed by adjacently disposed rectangular panels 24 supported by a grid 26 of interconnected cables 27*a*, 27*b* within the area defined by the end and side cables 20*a*, 20*a'*, 20*b*, 20*b'* 20*c* and 20*c'* and 20*d*, 20*d'*. The arrangement of this grid 26 of cables 27*a*, 27*b* may best be understood by a consideration of FIG. 3 of the drawings. Parallel longitudinal cables 27*a*, spaced from each other by a distance equal to the dimensions of a panel 24 plus the expanded length of two of the end springs 28 (FIG. 4), are provided to extend from the upper end cable 20*d* and over and secured to the lower end cable 20*b*, across the full length of the planar area 10, then over and secured to the opposite lower end cable 20*b'*, and up to the upper end cable 20*d'* to which latter cable the end of cable 27*a* is attached.

Correspondingly, the transverse cables 27*b* extend from upper side cable 20C over and secured to lower side cable 20*a* to and secured to the opposite lower side cable 20*a'* and up to the upper side cable 20*c'*.

Each of the panels 24 may be formed of a heavy duty fabric, such as sail cloth, the edges 26 of which are provided with outwardly extending springs 28 for hooking over or otherwise being secured to one of the cables 27*a* and 27*b*.

The sides 14*a*, 14*b* and ends 12*a* and 12*b* are formed of panels 38 which are generally similar to the panels 24, except for angular shaping at the corners 32*a*, 32*b*, 32*c* and 32*d*.

Figure 4:
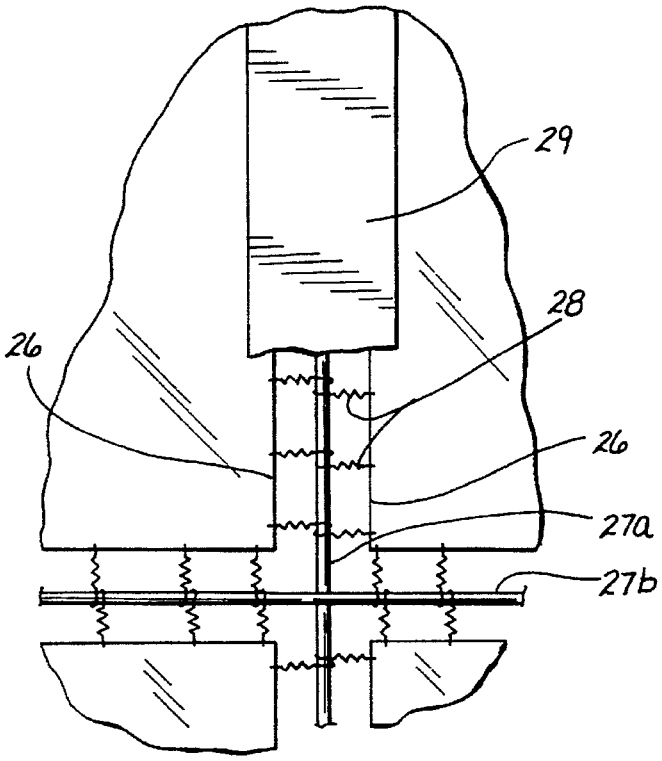
FIG. 4 is an enlarged top view of a cable intersection showing spring connections between the corners of the four panels and intersecting cables.
Figure 5:
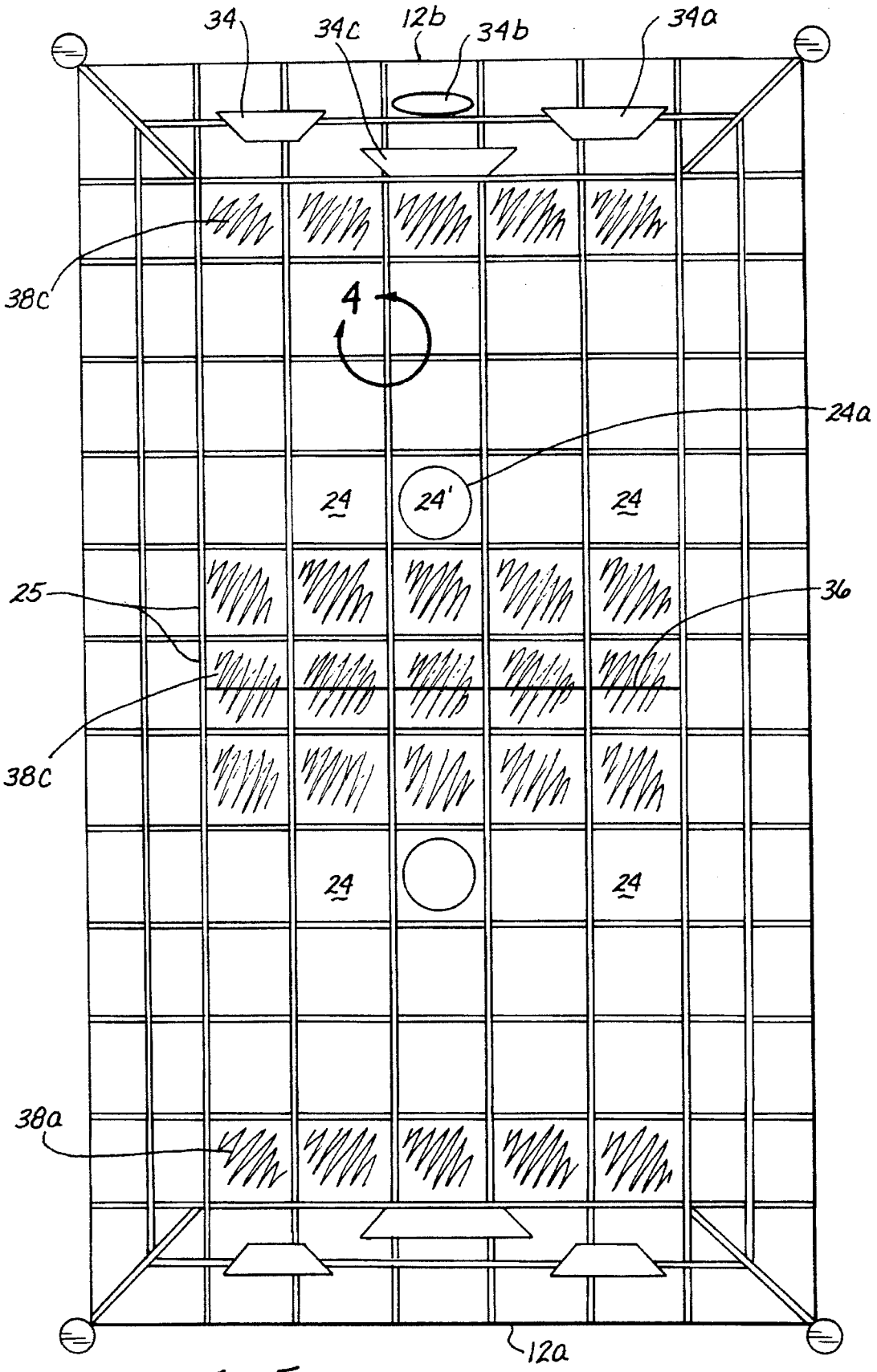
FIG. 5 is an enlarged plan view of the inside of the field as marked for the preferred embodiment of the game.

In order to prevent injury to the players who may either trip or fall onto the springs 28, where they attach to the cables 27*a*, 27*b*, 27*c*, 27*d* as shown in FIG. 4, a heavy-duty pad 29 with a cloth cover is provided to overlie the panel edges 26, the extending springs 28 and the cable 27*a* or 27*b* to which the springs 28 may be attached. This padding 29 may be held in place by attachment on its underside to the springs 28 and/or cable 27*a* (27*b*, 27*c* or 27*d*) and should overlap the panel edges 26.

Each end 12*a*, 12*b* of the assembly 10 may be provided with one or more openings 34, 34*a*, 34*b*, 34*c*, which may serve as goals for the game herein described to be played on the field or court 10. In addition, the entire field may be bisected by a line 36 and the panels 24 marked or colored to fit the rules of the game.

While different types of games may be played on the described field assembly 10, the presently preferred game would provide for three red or other special colored zones, 38*a*, 38*b* and 38*c*. The end zones 38*a* and 38*c* each comprise one set of adjacent panels which abut an end 12*a* or 12*b* of the field. The central zone 38*b* may comprise a block of three panels 24 lengthwise and all adjacent panels 24 from one side of the court to the other. When bisected by the line 36, the result is that each side of the field 10 will have a transverse block 25 of one and a half panels 24 extending for the full length of the bisector. Centrally disposed in the panel 24*a* on each side is a circular foul shot area 24'.

The presently preferred form of the game to be played on the field thus described in detail has been fully explained above in the Summary of the Invention, and need not be repeated at this point. Suffice it to say that the resiliency of the panels 24 connected by springs 28 to the grid 26 of cables 27*a*, 27*b*, 27*c*, 27*d* will result in quite different movements of players from those which would be expected as players traverse solid ground. In addition, because of the trampoline effect possible with each panel 24, the players, through bouncing or jumping movements, particularly near the centers of the panels 24 will be able to develop unusual and unexpected movements which may either enable them to avoid or pass by an opposing defensive player, or to block the approach of an offensive player or the passage of the ball which the offensive player may be attempting to throw into one of the end zone goals 34*a*, 34*b*, 34*c*, or 34*d*.

I claim:

1. A supported surface for transitional movement, said surface being formed of:

a. a grid of elongated steel cables disposed above a ground level, said grid being formed of a plurality of first parallel cables spaced from each other, and a plurality of second steel cables disposed transversely of and in abutment with the first cables, said second steel cables being parallel to, and spaced from, each other, said first and second cables defining a plurality of open spaces between the cables;

b. means to support each of said cables at their respective extremities;

c. a plurality of first panels, each of said first panels being formed of a yieldable heavy fabric having edges and each panel being configured to space its edges from either a first or second cable defining a space;

d. a plurality of resilient elements extending outwardly from each edge of each panel for attachment to the nearest of said first and second cables, thereby to support the panel on said first or second cables within a space defined by said cables; and, e. a plurality of elongated cover means, the last said means each comprising a padded sheet material having a width greater than the distance between parallel edges of adjacently disposed panels, each said cover means being disposed over at least a portion of one of the first and second cables and the resilient means attached thereto and extending from the edge of a first panel.

2. The supported surface as described in claim 1, wherein the resilient means are coil springs.

3. The supported surface as defined in claim 1, wherein the configuration of the surface is rectangular and the means to support the grid of cables comprises a first vertical post of a predetermined height disposed at each corner of the rectangle, and third steel cables each extending between adjacent corner posts thereby presenting pairs of oppositely disposed parallel cables, the first and second cables being secured to extend between one of the pairs of oppositely disposed parallel third cables.

4. The supported surface as defined in claim 3, wherein the perimeter of the surface is surrounded by outwardly angled side and end walls, each of said walls being formed of a plurality of second panels, supported by four second posts, each of said second posts being of a greater height than the first posts and disposed outwardly of, but in alignment with, a first post; and fourth steel cables, one of the last said cables extending between each pair of adjacent second posts, to result in two pairs of oppositely disposed parallel fourth cables, each of the first and second cables being secured to extend between a parallel pair of fourth cables, as well as, a parallel pair of third cables; and resilient means extending outwardly from the edges of each of the second panels and connected to one of the first, second, third, or fourth cables for planar support by three of said cables; and second cover means disposed to extend along and over the portion of each of the first, second, and third cables to which the edges of a second panel are attached by resilient means, the width of said cover means being greater than the distance between the edges of adjacent first and second panels.

5. The supported surfaces described in claim 4, wherein the first panels are marked by a line dividing the horizontal surface into two courts, and ball receptacles are provided in those of the second panels which are disposed opposite the dividing line.

6. The surface as described in claim 5, wherein preselected panels of the court on each side of the dividing line are colored to indicate areas involving specific requirements for the playing of a game.

7. The method of playing a sport game comprising the steps of:

a. providing a resilient court of a rectangular configuration having a predetermined length and width;

b. dividing the court lengthwise into two halves by a marker line;

c. providing at least one goal receptacle at each end of the court;

d. providing two teams of a preselected number of players and assigning each team to a different one of the two court halves;

e. providing a ball first to one team for predetermined time period, followed by providing the ball to the other team for a similar time period;

f. having the team provided with the ball attempt to cause the ball to enter the opponent's at least one goal;

g. having the other team not having the ball attempt to prevent entry of the ball into its at least one goal receptacle; and h. scoring the number of goal entries effected by each team.

8. The method of playing a game as described in claim 7, wherein areas of each half of the court are marked as by coloring, and requiring the players to engage in certain specified conduct when entering or remaining in each marked area.

9. The method of playing a games as described in claim 7, wherein the resilient court which is provided comprises a plurality of trampoline-type panels, each panel being disposed adjacently to other panels and all of the panels being supported by a grid of steel cables below the panels to which cables the edges of the panels are resiliently secured.

* * * * *

US005624122C1

(12) EX PARTE REEXAMINATION CERTIFICATE (8858th)

United States Patent
Winkelhorn

(10) Number: US 5,624,122 C1
(45) Certificate Issued: Feb. 21, 2012

(54) SPORT GAME AND FIELD

(75) Inventor: Karin-Maria K. Winkelhorn, Las Vegas, NV (US)

(73) Assignee: Skyzone, LLC, Las Vegas, NV (US)

Reexamination Request:
No. 90/012,003, Nov. 4, 2011

Reexamination Certificate for:

| | |
|---|---|
| Patent No.: | **5,624,122** |
| Issued: | **Apr. 29, 1997** |
| Appl. No.: | **08/683,669** |
| Filed: | **Jul. 17, 1996** |

(51) Int. Cl.
*A61B 71/00* (2006.01)

(52) U.S. Cl. ..... 473/471; 482/29
(58) Field of Classification Search ..... None
See application file for complete search history.

(56) References Cited

To view the complete listing of prior art documents cited during the proceeding for Reexamination Control Number 90/012,003, please refer to the USPTO's public Patent Application Information Retrieval (PAIR) system under the Display References tab.

*Primary Examiner*—Danton DeMille

(57) ABSTRACT

A competitive sport, and a facility for playing the same, the facility having a raised planar playing field formed of a plurality of rectangular trampoline-like channels held together edgewise by supporting cables with all of the adjacent edges and cables being covered by padding. The rectangular planar field is preferably circumscribed by additional similar panels angled upwardly and outwardly from the edges of the planar field with goals being provided in each of the end angled panels. The playing field may be divided and marked in predetermined ways depending upon the rules of the game. In one form, the game may involve two teams; one provided for each half of the field, with each team taking turns for prescribed periods in attempting to project a ball into a goal at the angled panels projecting upwardly from the end of the opponents' side of the field, while the defendant's attempt to thwart the defensive team's attempts to make a goal. The total number of goals scored by each team are totaled after the expiration of allowed play periods to determine the winning team.

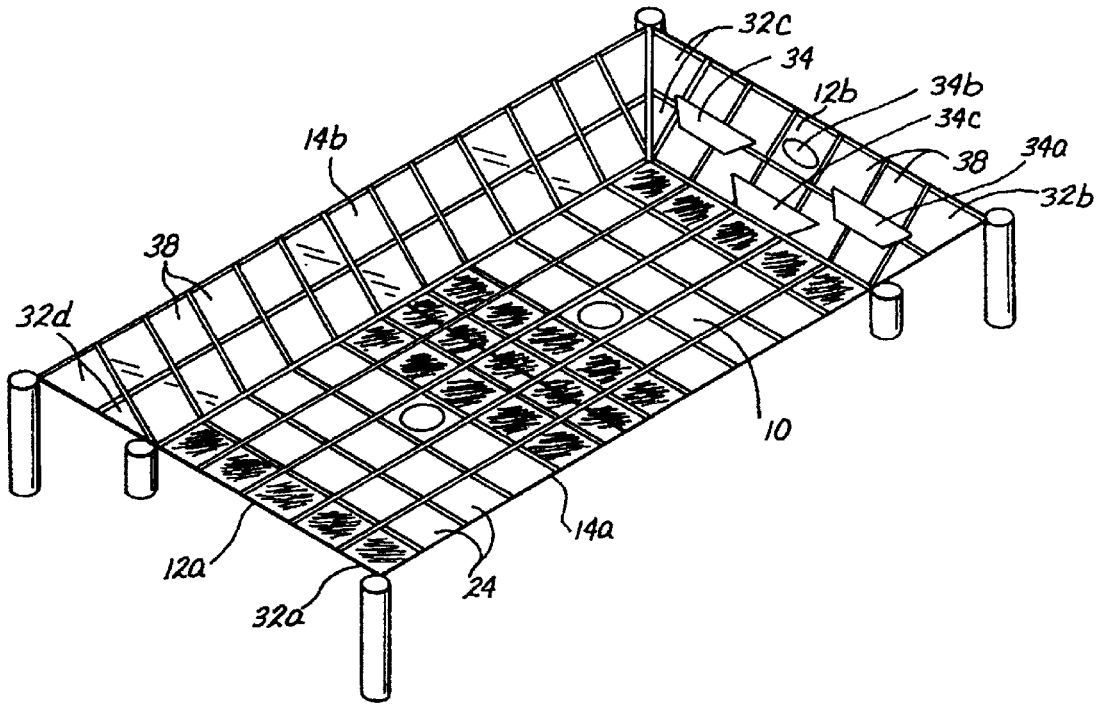

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-4 is confirmed.

Claims 5-9 were not reexamined.

* * * * *